US005664533A

United States Patent [19]

Nakayama et al.

[11] Patent Number: 5,664,533

[45] Date of Patent: Sep. 9, 1997

[54] AIR INTAKE DEVICE FOR AN INTERNAL COMBUSTION ENGINE

[75] Inventors: Toshiaki Nakayama, Nishikamo-gun; Shuya Mikami, Kariya; Yoshitaka Nishio, Nagoya; Akihide Yamaguchi, Kariya; Masao Ino, Toyota, all of Japan

[73] Assignee: Nippondenso Co., Ltd., Kariya, Japan

[21] Appl. No.: 715,820

[22] Filed: Sep. 19, 1996

Related U.S. Application Data

[62] Division of Ser. No. 579,606, Dec. 26, 1995, Pat. No. 5,575,247.

[30] Foreign Application Priority Data

Feb. 1, 1995 [JP] Japan ..... 7-15242
Jun. 7, 1995 [JP] Japan ..... 7-140644

[51] Int. Cl.[6] ..... F02M 35/10

[52] U.S. Cl. ..... 123/184.42; 123/184.61

[58] Field of Search ..... 123/184.21, 184.42, 123/184.46, 184.47, 184.61

[56] References Cited

U.S. PATENT DOCUMENTS

| | | | |
|---|---|---|---|
| 4,771,740 | 9/1988 | Koike | 123/184.42 |
| 4,821,685 | 4/1989 | Matsushima et al. | 123/184.47 |
| 4,848,280 | 7/1989 | Ohtsuka et al. | 123/184.42 |
| 4,898,125 | 2/1990 | Ampferer | 123/184.21 |
| 5,002,021 | 3/1991 | Nakata et al. | 123/184.42 |
| 5,259,356 | 11/1993 | Karlsson et al. | 123/541 |
| 5,572,965 | 11/1996 | Ohsuga et al. | 123/184.42 |
| 5,575,247 | 11/1996 | Nakayama et al. | 123/184.21 |

FOREIGN PATENT DOCUMENTS

| | | |
|---|---|---|
| 0 523 027 | 1/1993 | European Pat. Off. . |
| 0 644 326 | 3/1995 | European Pat. Off. . |
| 63-63577 | 4/1968 | Japan . |
| 63-100269 | 5/1988 | Japan . |
| 6-81735 | 3/1994 | Japan . |
| 63-183365 | 11/1995 | Japan . |

*Primary Examiner*—David A. Okonsky
*Attorney, Agent, or Firm*—Cushman, Darby & Cushman IP Group of Pillsbury Madison & Sutro LLP

[57] ABSTRACT

An air cleaner, a throttle, a surge tank and air-intake pipes of an intake manifold are combined in a unit and a fuel delivery pipe and fuel injectors are installed in the unit before the unit of an air-intake device is assembled to an internal combustion engine. Cases of the above members are integrally formed thereby to reduce the size of the device and material used for the device. A dusty-side of the air cleaner is disposed under a filter element to prevent dust and water from getting into the clean-side of the filter element when the element is removed to have serviced or inspected.

11 Claims, 13 Drawing Sheets

AIR INTAKE DEVICE FOR AN INTERNAL COMBUSTION ENGINE

This is a division of application Ser. No. 08/579,606, filed Dec. 26, 1995 and now U.S. Pat. No. 5,575,247.

CROSS REFERENCE TO RELATED APPLICATION

The present application is based on and claims priority from Japanese Patent Applications Hei 7-15242, filed on Feb. 1, 1995 and Hei 7-140644, filed on Jun. 7, 1995, the contents of which are incorporated herein by reference.

BACKGROUND OF THE INVENTION

1. Field of the Invention

The present invention relates to an air intake device for an internal combustion engine and, particularly, relates to an air intake device having an air cleaner and other parts related to the air intake devices combined in a unit.

2. Description of Related Art

Air intake devices for internal combustion engines are disclosed in Japanese Patent Unexamined Publications Hei 6-81735 and Hei 7-83132. Each of the above publications discloses an air intake device in which an intake manifold and an air cleaner are combined into a unit, and fuel injectors, an engine control circuit and a throttle are installed in the unit before the unit is mounted on an internal combustion engine.

European Patent Unexamined Publication 0523027A2 proposes also a unit in which an air cleaner, a throttle and an intake manifold are combined, and the injectors are disposed in the dusty side of the air cleaner.

However, each of the air cleaners disclosed in the above publications is disposed on the top of the unit, and an intake air passage which connects the air cleaner to the throttle is disposed under the air cleaner. As a result, if water gets into the filter element of the cleaner, it passes the filter element and reaches the throttle. In addition, when the element is removed for some reason such as service or inspection, dust may fall to a clean-side portion of the air cleaner and reach the throttle.

Injectors and/or an engine control circuit disposed in the intake air passage are subject to dust or other foreign particles produced from mixture of fuel, water and dust, thereby resulting in shortening life of the engine.

Further, conventional air-intake devices including the above-mentioned devices have spiral intake passages in order to tune the intake air characteristics to respective engines. It is, however, difficult to provide such complicated spiral air intake passages by molding from resinous material.

SUMMARY OF THE INVENTION

The present invention is made in view of the above problems, and a primary object of the present invention is to provide a compact air intake device which solves the above mentioned problems.

Another object of the present invention is to provide an air intake device which includes a case of an air filter element having an upper clean-side space and a lower dusty-side space with a mount member disposed adjacent to air-intake pipes of an engine, an engine control unit disposed in the dusty side space and fuel injectors fixed to the mount member.

Since the dusty side of the air cleaner is located under the filter element, water is collected in the dusty-side space and is not introduced into the throttle or the engine if water gets into the dusty-side space through an air inlet or some other gaps. If the filter element is removed from the device to be replaced or to have injectors checked or serviced, dust or some foreign particles fall only to the dusty-side space and may not go to the throttle after the filter element is fixed to the device.

Since the fuel injectors and the engine control unit (hereinafter referred to as the ECU) are disposed in the dusty side space, the size of the air intake device can be reduced, thereby shortening wire connections between the ECU and fuel injectors, and easy installation into the engine compartment.

In addition, since the ECU and the fuel injectors are cooled by the air passing through the dusty-side space, the ECU is prevented from overheating and the fuel injectors do not cause engine vapor lock.

Another object of the present invention is to provide an air intake device in which the filter element is detachably fixed to an opening of the case which provides access to the fuel injectors when the filter element is detached from the case.

Accordingly, inspection and service of the fuel injectors can be carried out only by removing the filter element and an air cleaner cap.

A further object of the present invention is to provide an air intake device in which the case accommodates an air duct for connecting the clean-side space with the throttle.

Since the duct, which is a portion of the air intake passage between the air cleaner 10 and the surge tank 80, is accommodated in the air cleaner, the air intake device can be made compact while maintaining sufficient low speed engine torque. The length of the duct can be changed without changing the position of the air cleaner even when the low speed torque of the engine is changed. As a result, the air intake device according to the present invention can be installed various kinds of engines only by changing parts and portions related to the duct and a spiral intake passage, which is difficult to mold from resinous material, is not necessary.

A further object of the present invention is to provide an air intake device in which an engine head cover, a dusty-side case of the air cleaner, a throttle case and a surge tank case are integrally molded from resinous material, and the head cover, the air cleaner, the throttle, the surge tank and the air-intake manifold are combined in a unit before mounted to the engine.

As a result, the air intake device can be made compact and easy to be mounted on an engine. Since such unit operates as a unit, it is especially beneficial to a manufacturer to check the operation of the device before mounted on an engine.

A further object of the present invention is to provide an air intake device in which the air duct is composed of a cover member integrally formed on the case.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENT

Preferred embodiments will be described with reference to appended drawings hereafter.

(First Embodiment)

A first embodiment is described with reference to FIG. 1 through FIG. 10.

Figure 1:
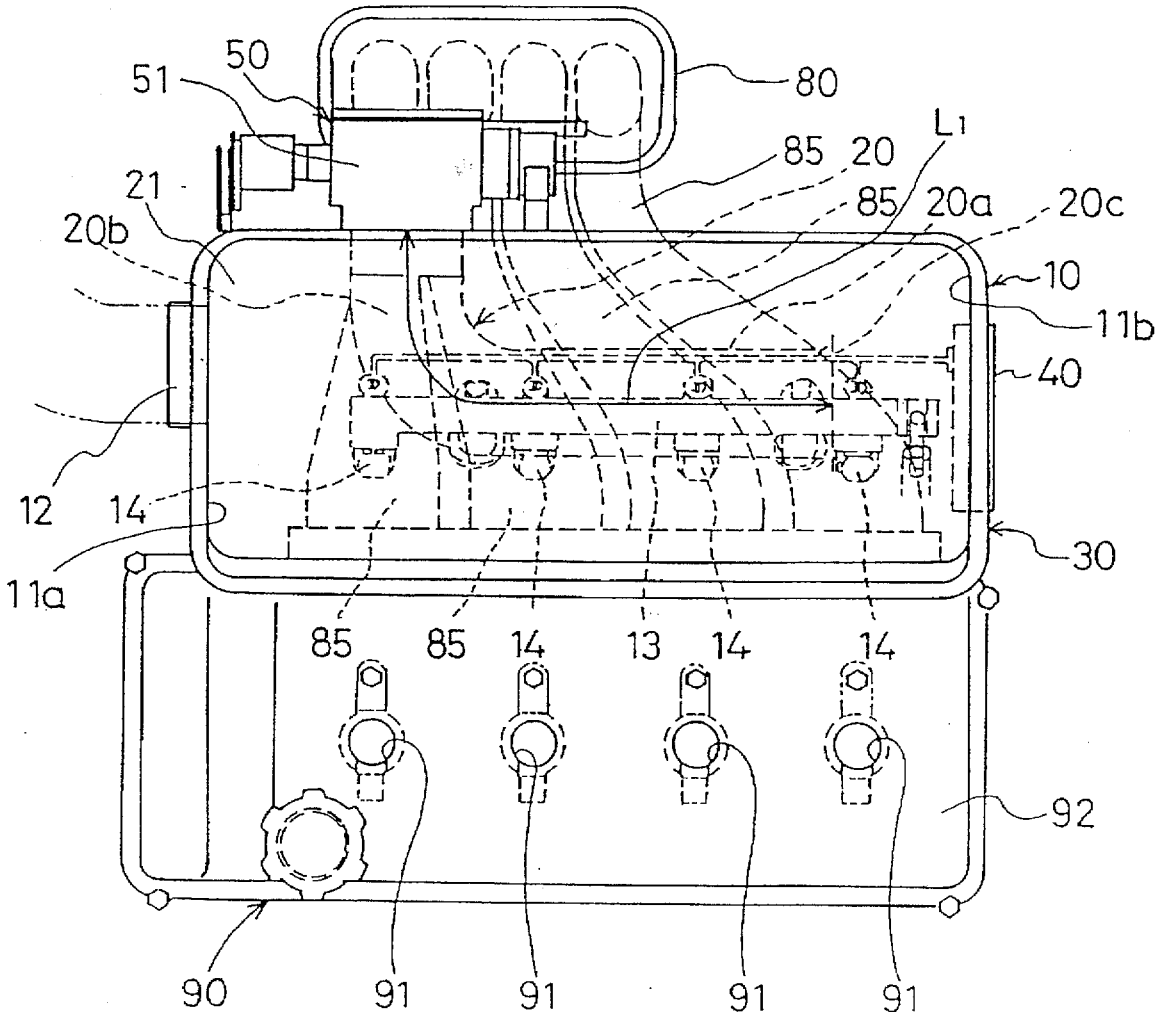
FIG. 1 is a plan view illustrating an air intake device according to a first embodiment of the present invention.
Figure 2:
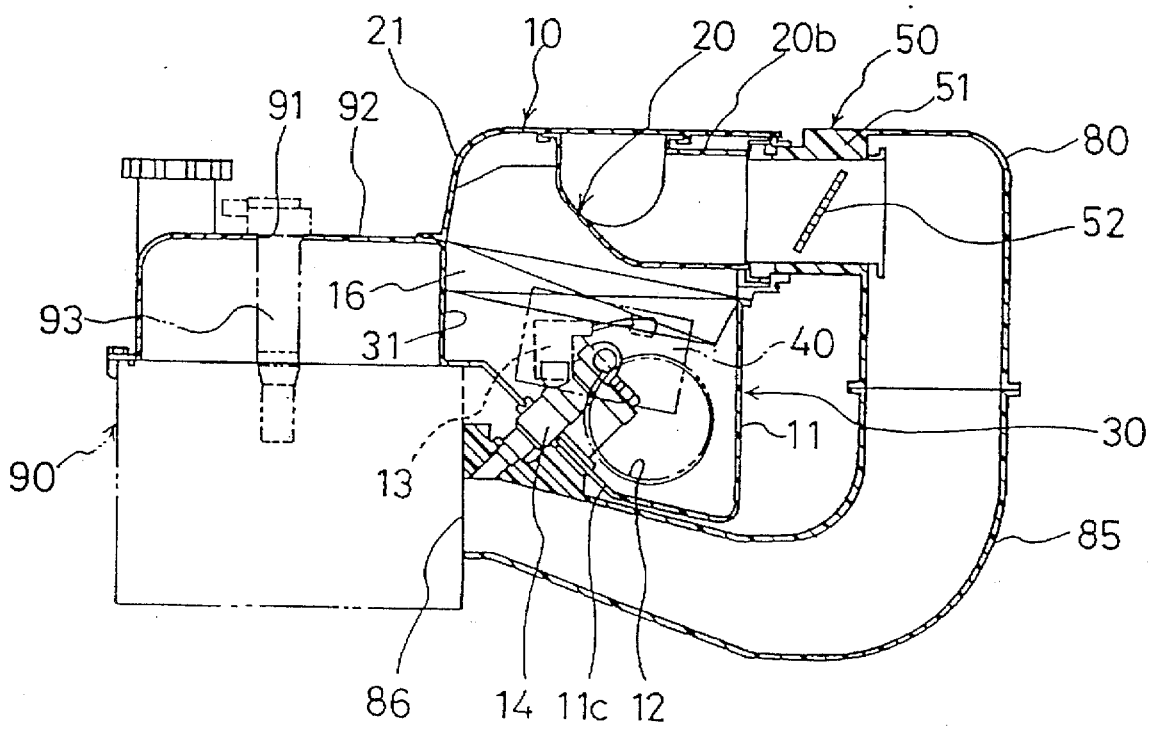
FIG. 2 is a cross-sectional side view illustrating a main portion of the air intake device illustrated in FIG. 1.

In FIGS. 1 and 2, an air cleaner 10 of an internal combustion engine 90 is disposed adjacent to an engine head cover 92 which has openings for receiving ignition coils 91. A throttle 50 having a throttle valve 52 and a throttle bore 51 is disposed at a side of the air cleaner 10 opposite the engine 90. The air cleaner 10 is connected with a surge tank 80 through the throttle bore 51, and the surge tank 80 is connected through a plurality of air-intake pipes 85 of an intake manifold made of resinous material or metal, which extends from the surge tank 80 under the air cleaner, to respective intake ports 86 of the engine 90.

A case 30 of the air cleaner 10 is composed of a dusty-side case 11 (upstream side of the air cleaner 10) made of resinous material and an air cleaner cap 21 made of resinous material and extends along a line of engine cylinders to cover the entire row of the intake pipes 85. A filter element 16 is disposed in the case 30 between the dusty-side case 11 and the air cleaner cap 21 to partition the inside space of the case 30 into a dusty-side space and a clean-side space. The dusty-side space is disposed under the element 16 as shown in FIG. 2. An air inlet 12 is formed on a wall (hereinafter referred to as the first wall) 11*a* of the dusty-side case 11 perpendicular to the line of the engine cylinders as shown in FIG. 1.

The case 30 is located adjacent to the throttle 50 as shown in FIG. 2. A delivery pipe 13 which is connected to a fuel pump (not shown) and a plurality of fuel injectors 14 (corresponding to the engine cylinders) are disposed in the case 30. Each of the injectors 14 is inserted into a corresponding one of the intake pipes 85 through the bottom wall 11*c* of the case 11 and fastened by a bolt thereto from the inside thereof along with portions of the intake-pipe 85, dusty-side case 11 and the delivery pipe 13.

Figure 9:
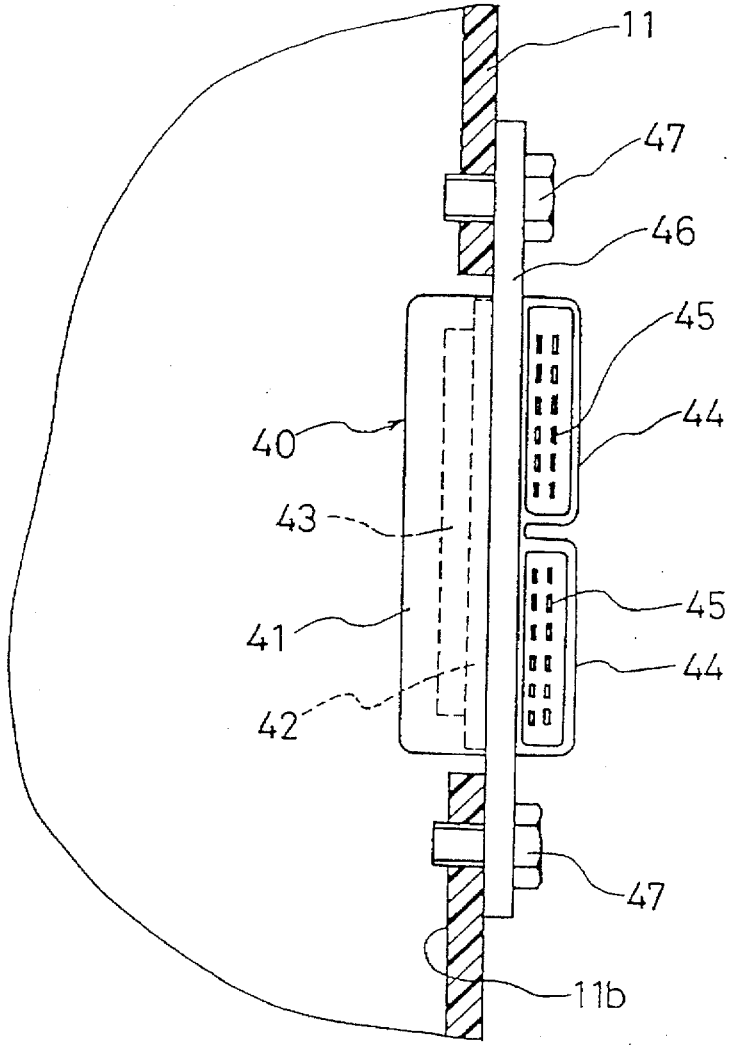
FIG. 9 is a cross sectional plan view illustrating a terminal portion of an ECU Of the air intake device according to the first embodiment.
Figure 10:
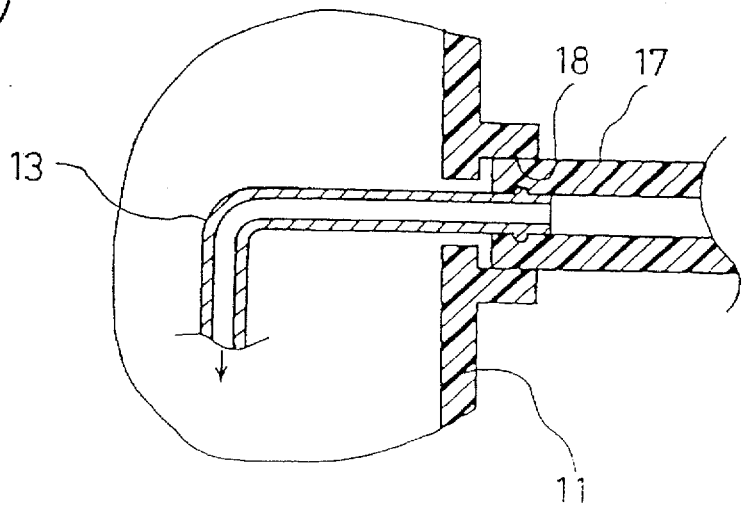
FIG. 10 is a cross-sectional side view illustrating a fuel passage of the air intake device according to the first embodiment.

An ECU 40 is secured to a second wall 11*b* of the dusty-side 11 which is located on the opposite side of the first wall 11*a*. The ECU 40 is composed of a case 41, connectors 44 fixed to the case 41, a printed circuit board 42 disposed in the case 41, circuits elements 43 formed on the circuit board 42*b* and a base plate 46 which is fastened to the second wall 11*b* by bolts 47 as shown in FIG. 9. The connectors 44 have, respectively, a plurality of connector pins 45 connected to the circuit elements 43, and are disposed on the second wall 11*b* to open to the outside of the dusty-side case 11. A hose 17 is connected between a fuel pump (not shown) and an opening 18 of the dusty-side case 11, and an end of the delivery pipe 13 is inserted into the hose 17 as shown in FIG. 10. Thus, fuel is supplied to the fuel injectors 14 from the fuel pump through the hose 17 and delivery pipe 13. The injectors 14 are controlled by the ECU 40 to supply the fuel to the engine 90.

Figure 5:
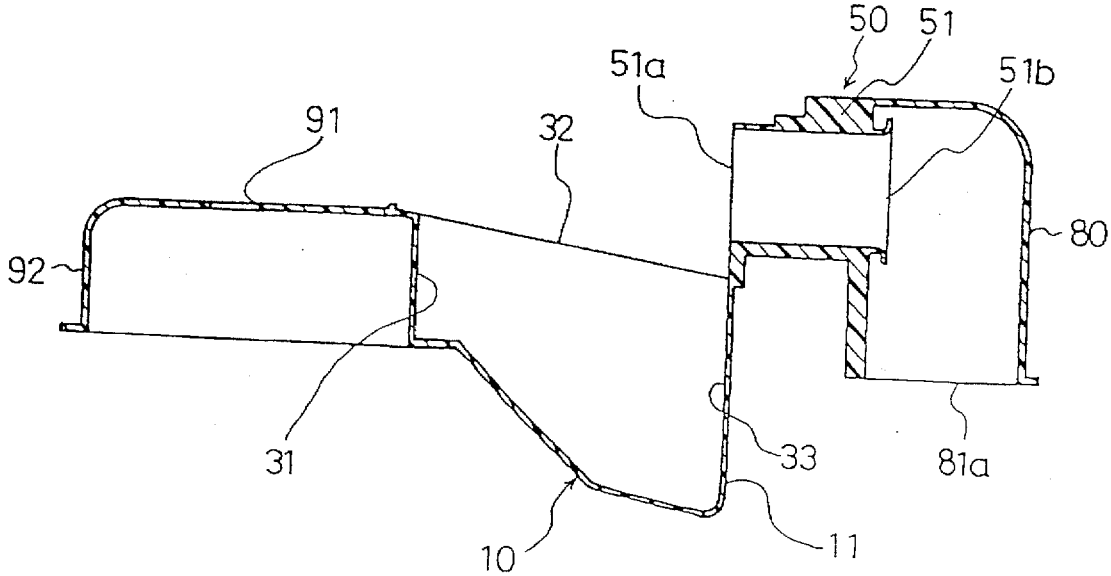
FIG. 5 is a cross sectional side view cut along a line V—V of FIG. 6.
Figure 6:
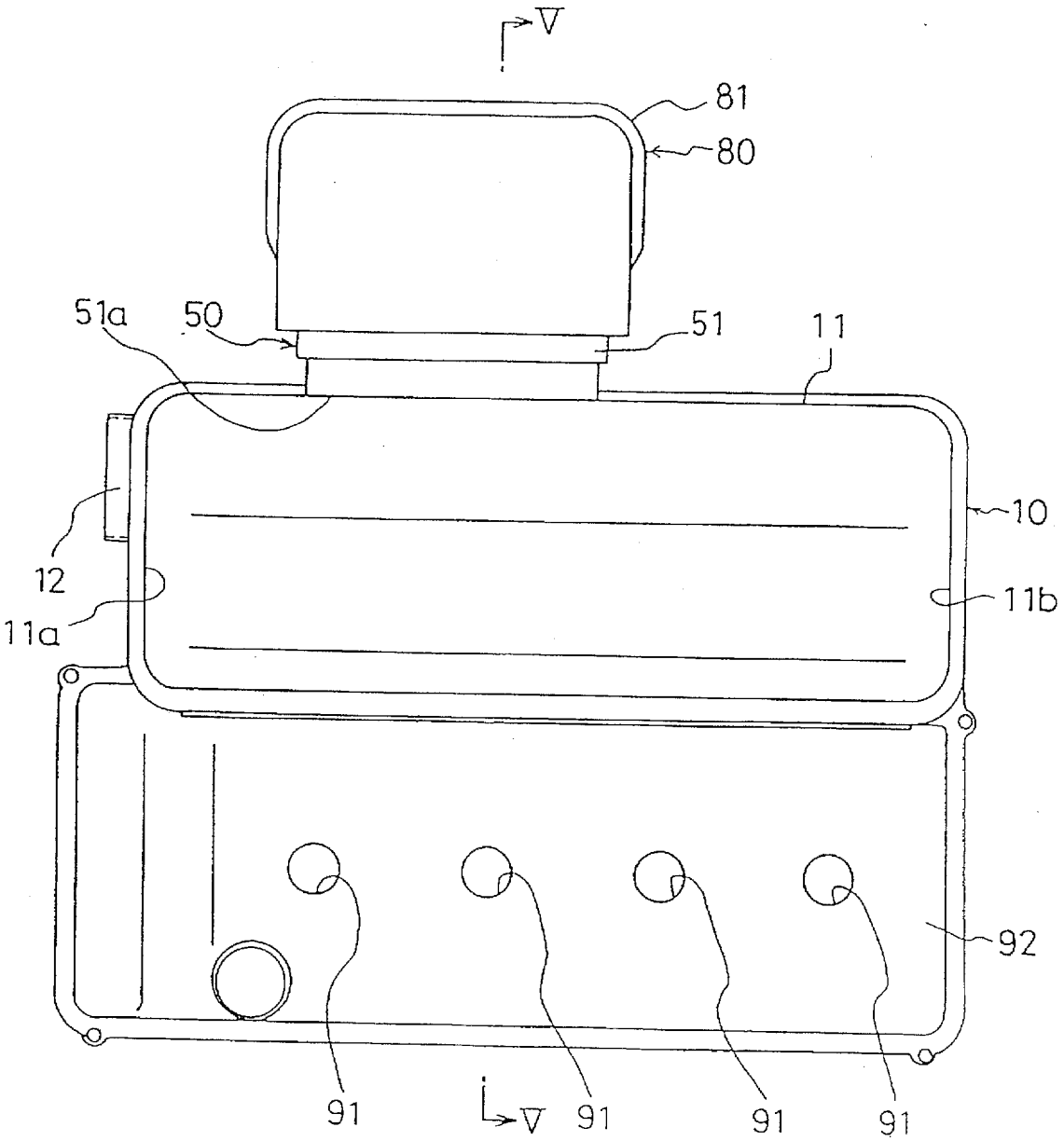
FIG. 6 is a plan view illustrating a mold member of the air intake device according to the first embodiment.
Figure 8:
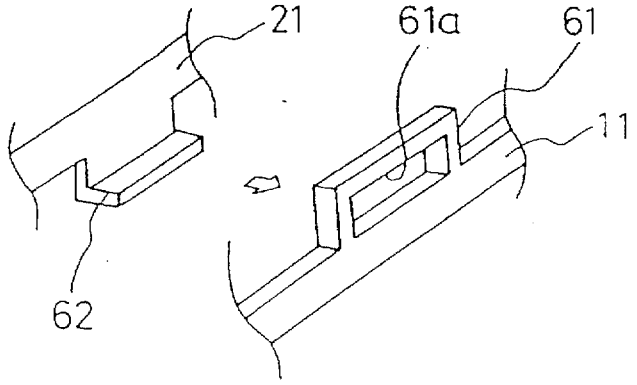
FIG. 8 is a perspective view illustrating an air cleaner cap to be fixed to a dusty side of the air cleaner.

The engine head cover 92, dusty-side case 11, the throttle bore 51 and the surge tank 80 are combined into a unit and molded integrally out of resinous material as shown in FIG. 5 and FIG. 6. An engine side wall 31 is owned jointly by the dusty-side case 11 and the head cover 92. An upper open end 32 of the dusty-side case 11 has ear members 61 with fixing holes 61*a*, which are engaged with hook members 62 formed on a periphery of the air cleaner cap 21 as shown in FIG. 8. The throttle bore 51, which is disposed at the side of the dusty-side case 11 opposite the engine 90, has an open end 51*a* opens to a portion above the open end 32 of the dusty-side case 11 and the other end 51*b* opens to the inside of the surge tank 80 formed adjacent to an outer periphery of the throttle 50.

A duct 20 made of resinous material extends in the air cleaner cap 21. The duct 20 is composed of a half member 20*a* having a semicircular cross-section shown in FIG. 4 and a cylindrical member 20*b* (shown in FIG. 2 and FIG. 3) connected between the half member 20*a* and the throttle bore 51. The duct 20 has an air intake portion 20*c*, which has a bell-mouth for reducing air resistance. The duct 20 is formed when the half member 20*a* is placed on the air cleaner cap 21 as shown in FIG. 4 (the upper wall of the cleaner cap 21 is shown on the downside). The cylindrical portion 20*b* is connected to the open end 51*a* of the throttle bore 51 air tightly by a sealing gasket 63 disposed therebetween and bonding agent 64 filled between an outer periphery of the cylindrical portion 20*b* and the air cleaner cap 21 as shown in FIG. 7 and, therefore, no bolt or other fastening member is necessary.

Figure 3:
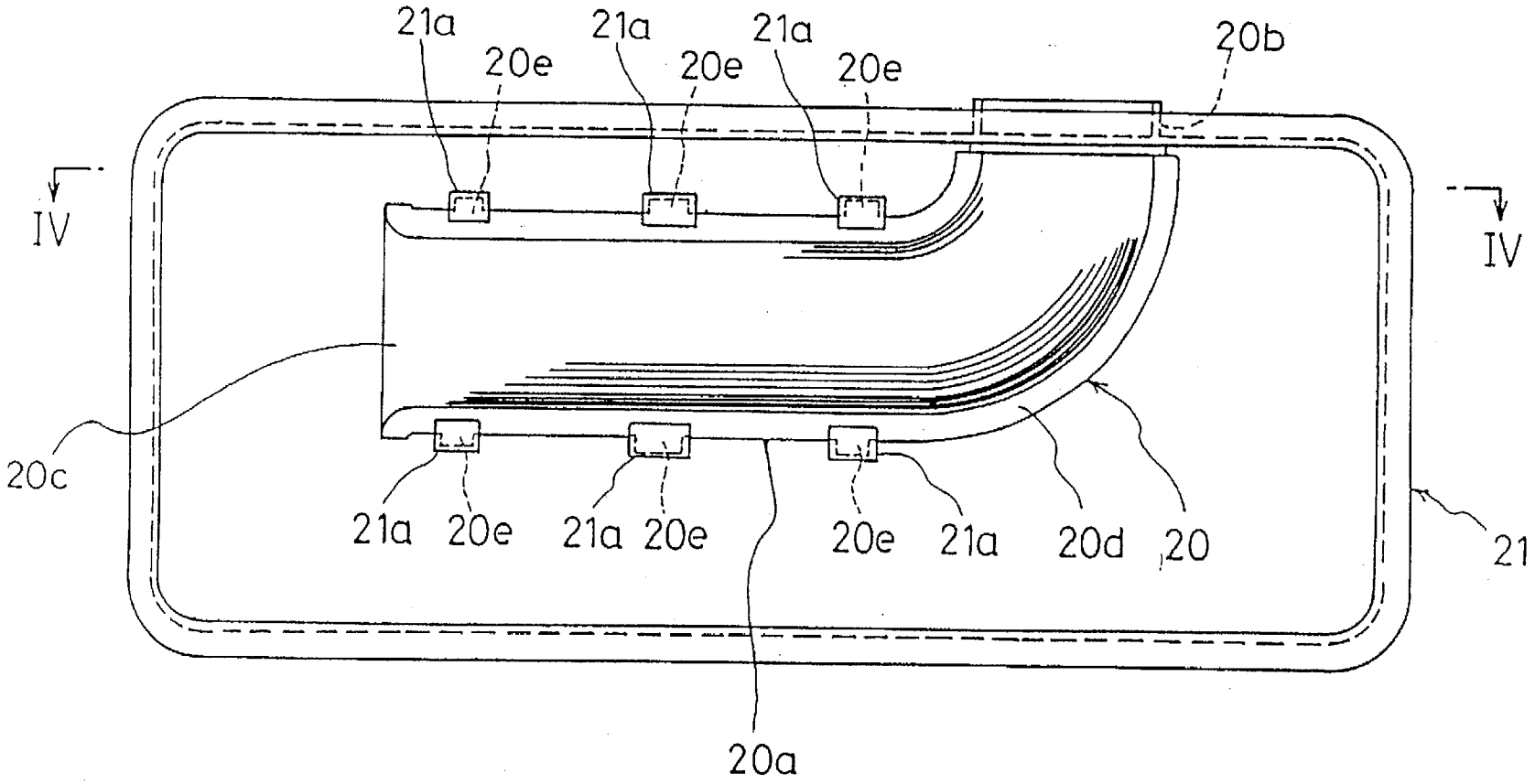
FIG. 3 is a plan view illustrating a duct of the air intake device shown in FIG. 1.
Figure 4:
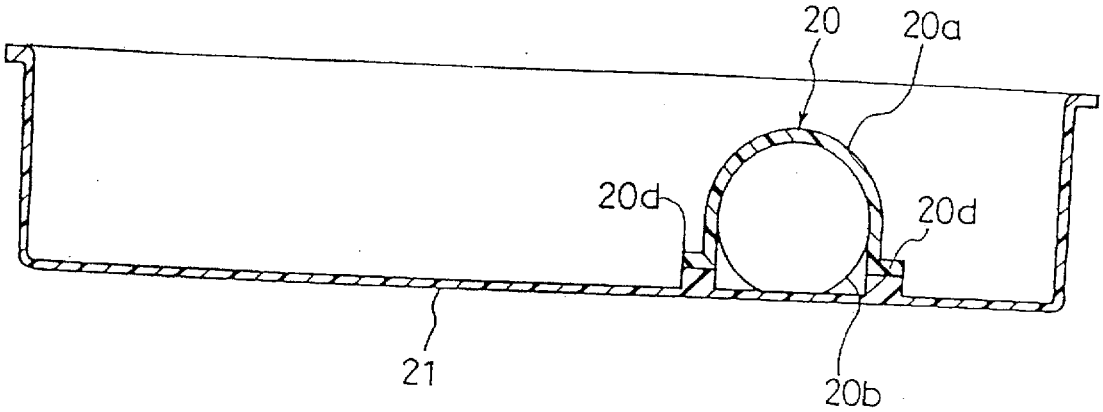
FIG. 4 is a cross-sectional side view cut along a line IV—IV of the duct illustrated in FIG. 3.

The half member 20*a* of the duct 20 has elongated flange portions 20*d* and fixing portions 20*e* formed on the flange portions 20*d* at an equal interval, which are fitted to fixing members 21*a* formed at corresponding portions on the inner surface of the air cleaner cap 21 as shown in FIG. 3. Then, the flanges 20*d* are welded to the inner surface of the air cleaner cap 20. Thus, the duct 20 is formed in the clean side of the air cleaner 10 and the air cleaner cap 21 is reinforced by the duct 20 thereby to reduce noise emitted from the upper portion of the air cleaner 10. That is, a part having length L1 of the air intake passage between the air cleaner 10 and the surge tank 80 is accommodated in the air cleaner 10 as shown in FIG. 1.

When the air intake device is assembled, the ECU 40 is fixed to the dusty-side case 11 as shown in FIG. 9 and fuel supplying parts are installed in the dusty-side case 11 and, therefore, electric wiring between them is simple. The intake manifold 85 is fixed to the bottom of the surge tank 80 by welding or bolts. After the filter element 16 is installed in the dusty side case 11, the air cleaner cap 21 is placed thereon and fixed in a detachable manner by the hook members 62 and the fixing holes 61*a*, as described before and shown in FIG. 8, and also by a clip (not shown) which extends from the dusty-side case 11 to hold the air cleaner cap 21.

Figure 7:
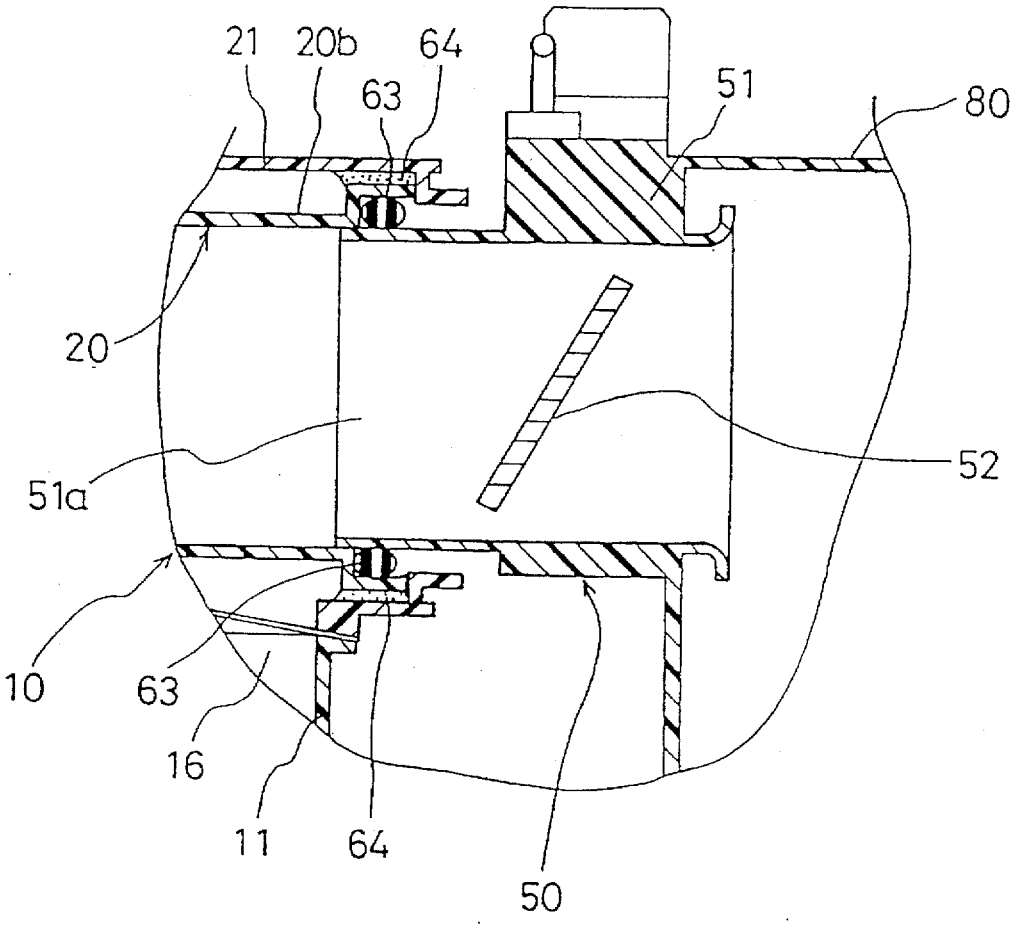
FIG. 7 is a cross-sectional side view illustrating an air cleaner cap and a throttle of the air intake device according to the first embodiment.

Since the cylindrical portion 20*b* and the throttle bore 51 open in the same direction as the direction in which the air cleaner cap 21 is placed on the dusty-side cap 11, the cylindrical portion 20*b* is automatically connected to the throttle bore 51 when the air cleaner cap 21 is placed on the dusty-side case 11, as shown in FIG. 7.

Thus, the head cover 92, the air cleaner 10, the throttle 50, the surge tank and the air intake manifold 85 are assembled in a unit and fixed to the engine 90 and, therefore, installation of the air intake device becomes easy.

Operation of the air intake device is described next.

Air introduced from the air inlet 12 into the dusty side case 11 is filtered by the filter element 16 to remove dust, and is introduced into the clean side of the air cleaner 10. The clean air goes through the intake portion 20*c* of the duct 20 and the throttle 50 to the surge tank 80. Then, the air is distributed to each of the intake pipes 85 of the intake manifold to be supplied to each one of the cylinders of the engine 90 from each one of the, intake ports 86. The quantity of the air introduced into the inlet 12 is controlled by the throttle valve 52.

Since the ECU 40 and the fuel supplying parts are disposed in the dusty side case 11 of the air cleaner 10 and between the head cover 92 and the surge tank 80, the size of the air intake device can be reduced, resulting in short wiring between the ECU 40 and other electric parts and easy installation into the engine compartment. In addition, since the ECU 40 and the fuel supplying parts are cooled by the air passing through the air cleaner 10, the ECU 40 is prevented from overheating and the fuel supplying parts does not cause the vapor lock of the engine.

Further, since the open end of the dusty-side cover 11 provides a wide space, inspection and service of the fuel injectors 14 can be carried after only the air cleaner cap 21 and the filter element 16 are removed from the air cleaner 10.

Furthermore, if water is introduced into the dusty-side case 11 through the intake passage or some other gaps or spaces, it is collected in the dusty-side case 11 and is not introduced into the engine 90 since the dusty side of the air cleaner is located under the filter element 16.

Furthermore, since the duct, which is the portion having length L1 of the air intake passage between the air cleaner 10 and the surge tank 80, is accommodated in the air cleaner as shown in FIG. 1, the air intake device can be made compact while maintaining sufficient low speed torque. The length of the duct can be changed without changing the position of the air cleaner 10 in order to change the low speed torque of the engine. As a result, the air intake device according to the first embodiment can be installed various kinds of engines by changing only parts and portions related to the duct.

(Second Embodiment)

Figure 11:
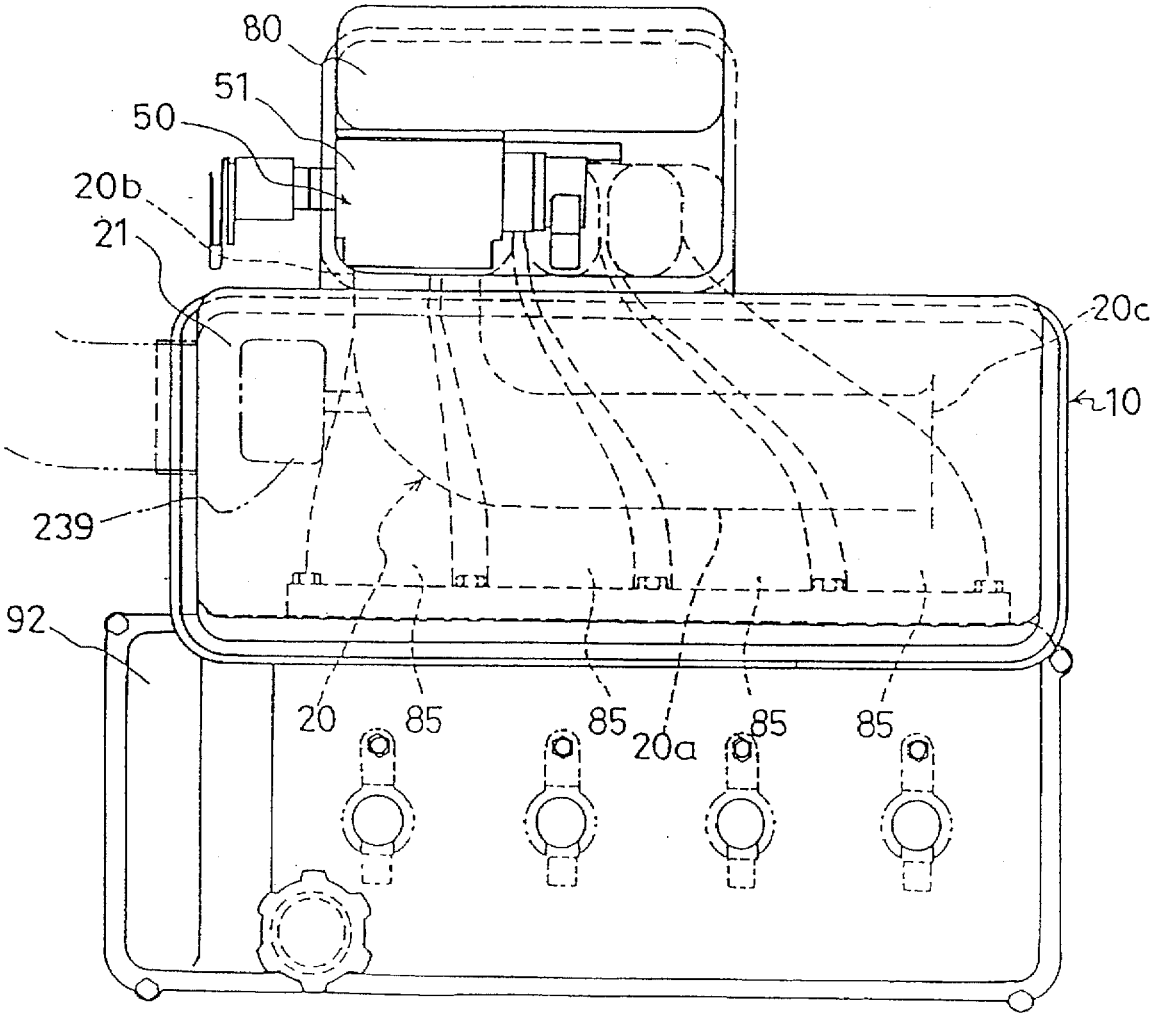
FIG. 11 is a plan view illustrating an air intake device according to a second embodiment of the present invention.

An air intake device according to a second embodiment of the present invention is described with reference to FIG. 11.

Incidentally, the same reference numerals used in the following drawings for this and other embodiments indicate the same or the substantially the same parts or portions and, therefore, the detailed descriptions thereon are omitted.

A duct 20, which is disposed in the air cleaner cap 21, has a resonator 239 for changing the resonating frequency of noise generated by an engine.

Since the resonator 239 is disposed in the clean side of the air cleaner, only simple sealing is required, and the air intake device can be made compact.

(Third Embodiment)

An air intake device according to a third embodiment of the present invention is described with reference to FIGS. 12 through 16.

Figure 12:
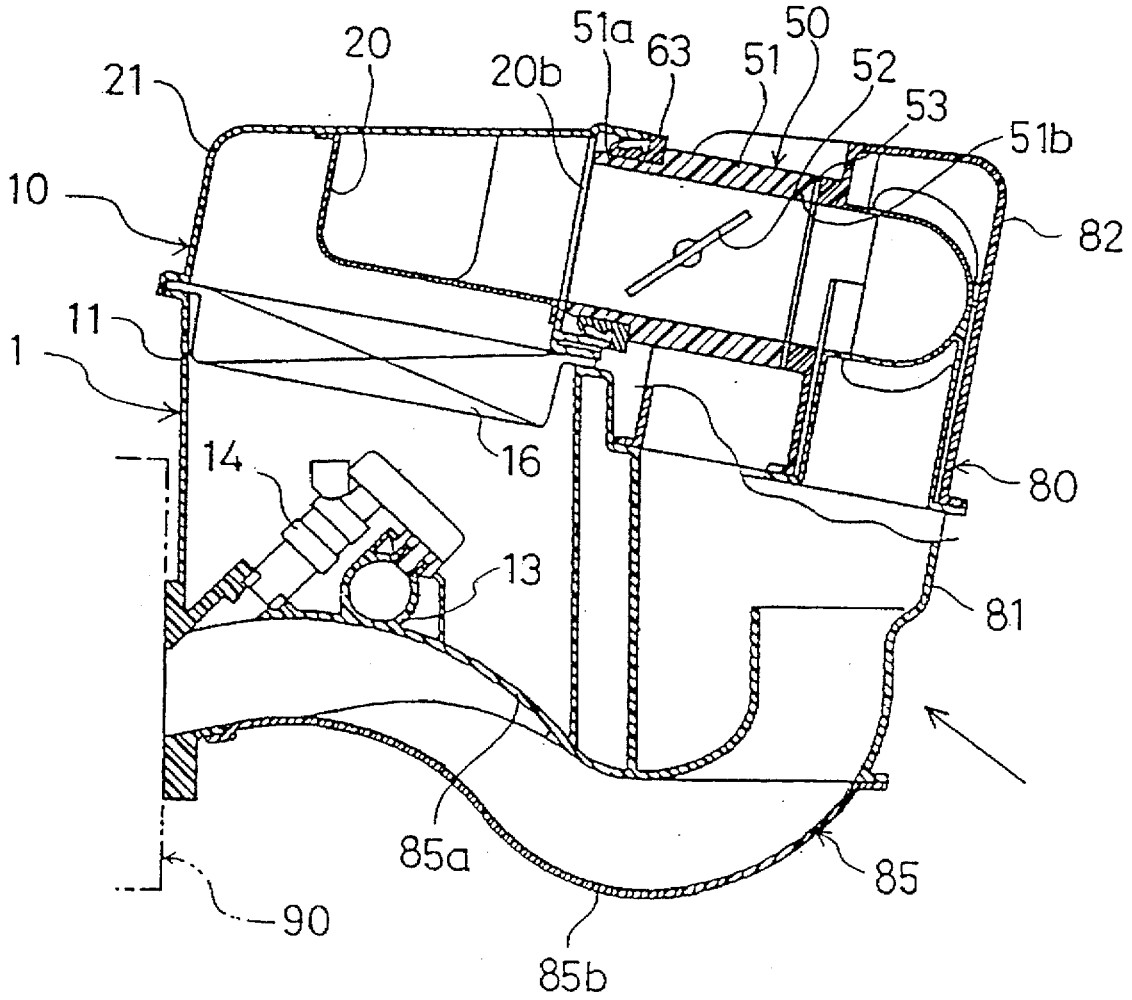
FIG. 12 is a cross-sectional schematic side view illustrating an upper main portion of an air intake device cut along a line XIIB—XIIB and a lower main portion cut along a line XIIA—XIIA shown in FIG. 13.
Figure 13:
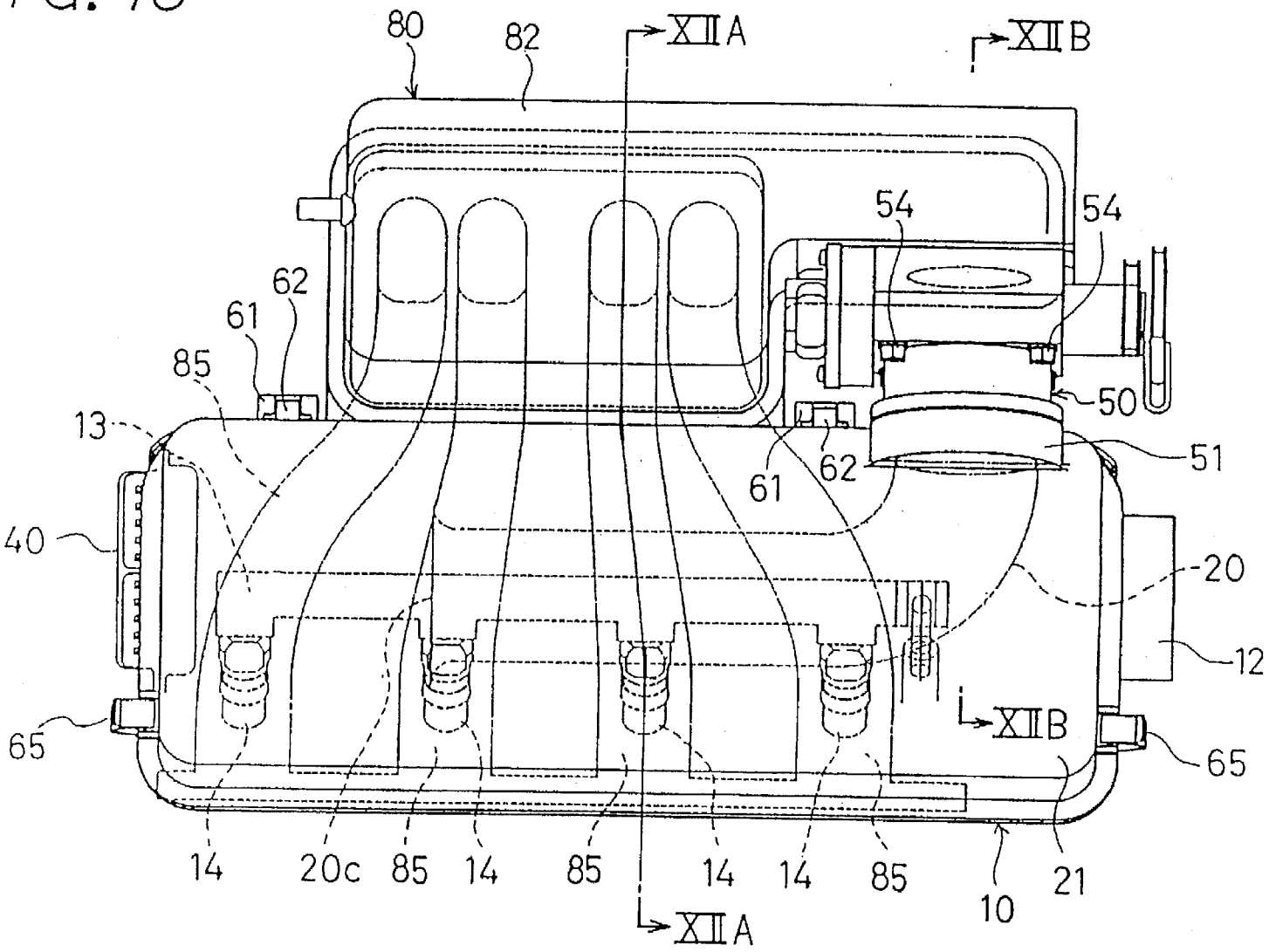
FIG. 13 is a plan view illustrating an air intake device according to a third embodiment of the present invention.

The air intake device is used for a four-cylinder engine, and composed of an air cleaner 10 which has an air cleaner cap 21 made of resinous material and a dusty-side case 11, a surge tank 80 which has a surge tank cap 82 and a lower case 81 bonded together by ultrasonic bonding or the like, a throttle 50 which has a throttle bore 51 and a throttle valve 52 and an intake manifold which has a plurality of suction pipes 85, as shown in FIGS. 12 and 13. The suction pipes 85 are formed between an upper wall portion 85*a* and lower wall portion 85*b*.

Figure 14:
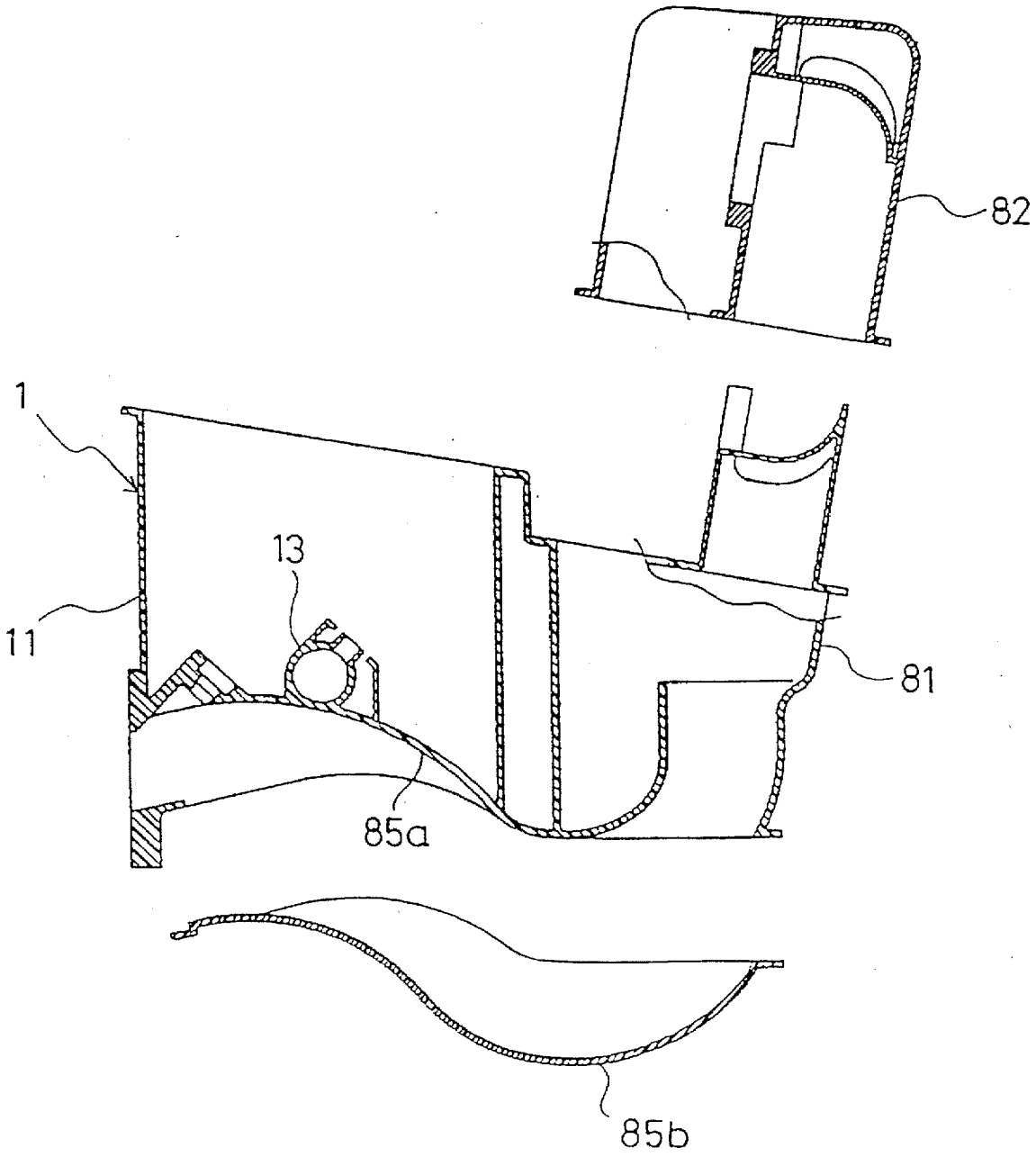
FIG. 14 is an exploded-cross-sectional side view illustrating a mold member of the upper and lower main portions illustrated in FIG. 12.

The dusty-side case 11 of the air cleaner 10, the upper wall portion 85*a* of the intake manifold, the lower case 81 of the surge tank 80 are molded into a unit 1 of resinous material as shown in FIG. 14. The upper wall portion 85*a* is formed as a common bottom member of the dusty-side case 11 and the lower case 81. A delivery pipe 13 is also formed integrally on the dusty-side case 11 as shown in FIG. 12.

The air cleaner 10 is composed of the dusty-side case 11 and the air cleaner cap 21. The dusty-side case 11 has a plurality of fixing members 61 each having a fixing hole on a periphery of the upper open end, and the air cleaner cap 21 has the same number of fixing hooks 62 at portions corresponding to the fixing holes (as shown in FIG. 8 for the first embodiment). An air inlet 12 is formed on the dusty-side case 11 as shown in FIG. 13, a filter element 16 is disposed between the dusty-side case 11 and the air cleaner cap 21 to partition the inner space of the air cleaner to form a dusty-side space under the filter element 16 and a clean-side space thereabove as shown in FIG. 12.

Figure 15:
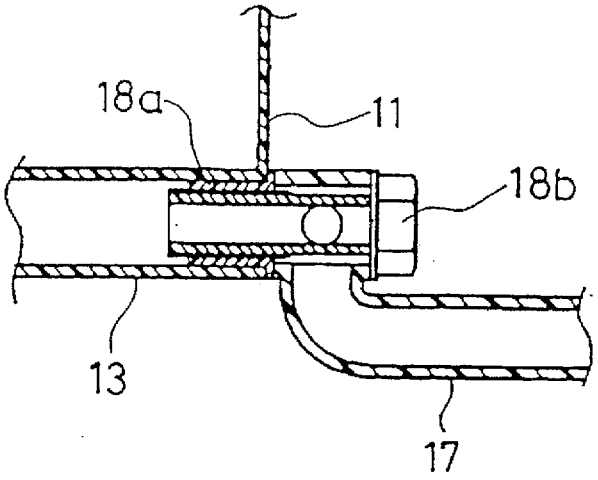
FIG. 15 is a cross-sectional side view illustrating a fuel passage of the air intake device according to the third embodiment.
Figure 16:
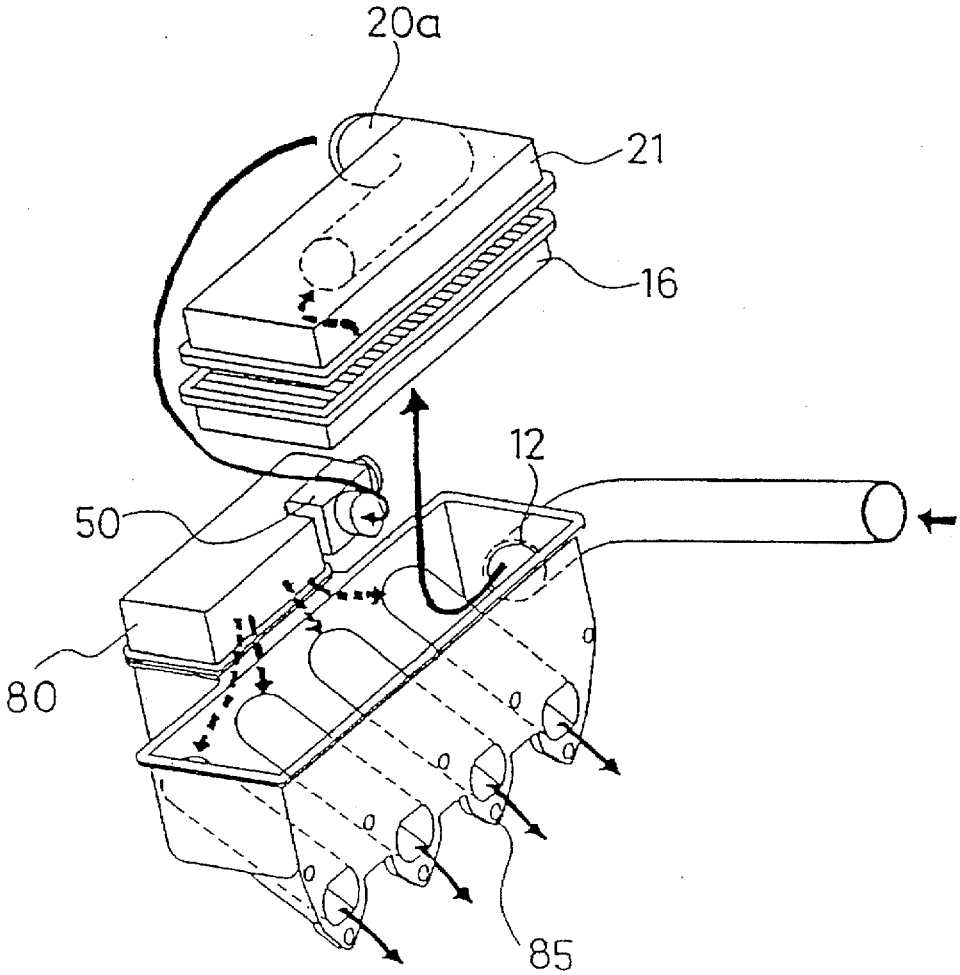
FIG. 16 is a perspective schematic view illustrating air flow in the air intake device according to the third embodiment.

Four fuel injectors 14 corresponding to engine cylinders are housed in the dusty-side case 11 and secured thereto by bolts (not shown) so as to inject fuel into the respective suction pipes 85 through the corresponding upper wall portion 85*a*. The injectors 14 are connected to the delivery pipe 13, which has one end disposed outside the dusty-side case 11 and connected to a fuel supply hose 17, which is connected to a fuel pump (not shown, by a nipple, a bolt 18*b* and a nut 18*a* as shown in FIG. 15. An ECU 40 is disposed inside the dusty-side case 11 and fixed to a wall opposite a wall having the air inlet 12. The air cleaner cap 21 is placed on an open end of the dusty-side case 11. A cylindrical duct 20, which is made of resinous material, extends in the air cleaner cap 21. The duct 20 is bonded to the inner surface of the air cleaner cap 21 by ultrasonic bonding or the like. The duct 20 has a bell-mouth 20*c* for reducing air resistance as shown in FIG. 13.

The throttle 50 has a throttle bore 51 and a throttle valve 52 as shown in FIG. 12. An end 51*a* of the throttle bore 51 is connected to an end 20*b* of the duct via a sealing gasket 63 made of rubber. The other end 51*b* of the throttle bore 51 is connected to the surge tank cap 82 through a gasket 53 and fastened by bolts 54 as shown in FIGS. 12 and 13.

When the air intake device is assembled, the upper wall portion 85*a* and the lower wall portion 85*b* are bonded together by ultrasonic bonding or the like to form four air-intake pipes 85. Then, the ECU 40 is fixed to the dusty-side case 11, and the injectors 14 and other related parts are fixed in the dusty-side case 11 as shown in FIGS. 12 and 13. Thereafter, the throttle bore end 51*b* is connected to the surge tank cap 82, and they are welded together by supersonic bonding or the like as shown in FIG. 12.

After the air filter element 16 is placed on the upper open end of the dusty-side case 11, the air cleaner cap 21 is fixed to the dusty-side case 11 with the fixing members 62 being inserted into the fixing holes of the dusty-side case 11 in a detachable manner as shown in FIG. 13. The air cleaner cap 21 is held by metal clamps 65 thereafter. When the cleaner is fixed to the dusty-side case 11, the duct end 20*b* is automatically connected to the throttle bore end 51*a* as shown in FIG. 12. Thus, the air intake device is assembled and mounted on the engine as a unit.

Operation of the air intake device according to the second embodiment is described next.

Air is introduced into the dusty-side case 11 from an air intake duct through the air inlet 12. The air is filtered by the filter element 16 and is introduced into the clean-side space of the air cleaner 10 and sent to the surge tank 80 through the duct end 20*b* and the throttle 50. The air introduced into the surge tank 80 is distributed to the respective air intake pipes 85, and supplied to the respective cylinders of the engine 90 through the intake ports thereof.

Fuel supplied by the fuel pump is introduced into the delivery pipe 13 through the fuel supply hose 17 and distributed to each of the injectors, which inject fuel into the respective engine cylinders according to signals from the ECU 40.

Since the air intake manifold is formed by the upper wall portion which is formed on the unit 1 and the lower wall portion 85*b* which is separate from the unit 1, no particular molding machine is required for providing the unit 1 and the member forming the lower wall portion 85*b*.

(Fourth Embodiment)

Figure 17:
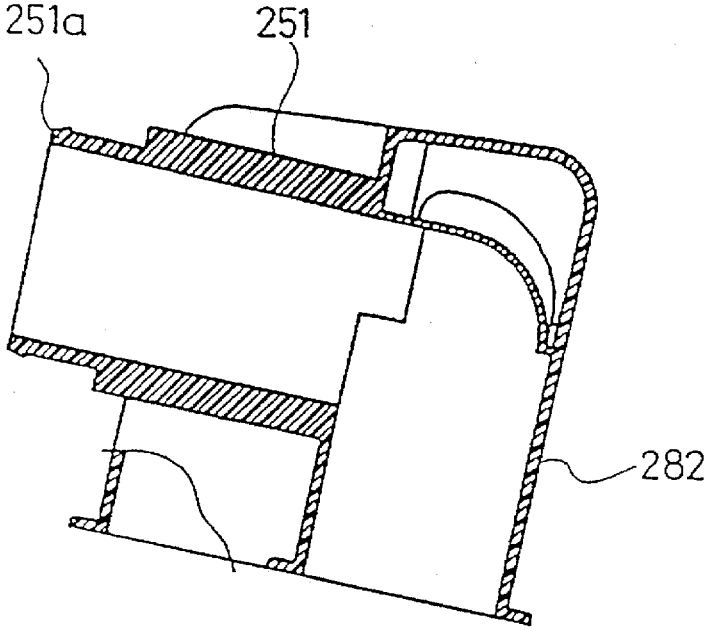
FIG. 17 is a cross-sectional side view illustrating a mold member of a throttle and a surge tank cap of an air intake device according to a fourth embodiment of the present invention.

A fourth embodiment is described with reference to FIG. 17 next.

A throttle bore portion 251 and a surge tank cap portion 282 are formed into a unit in this embodiment. An end 251*a* of the throttle bore 251 is provided with a sealing gasket (not shown) to connect a duct of an air cleaner (reference numeral 10 in the preceding embodiment). Other portions are substantially the same as the third embodiment.

When the air intake device is assembled, the lower portion of the surge tank cap 282 is paced on the upper open end of a housing lower case (reference numeral 81 in FIG. 12), and they are welded together. Then, the air cleaner cap (reference numeral 21 in FIG. 12) is placed on a dusty-side case (reference numeral 11 in FIG. 12), and the throttle end 251*a* is inserted into a duct end (reference numeral 20*b* in FIG. 12), thereby connecting the air cleaner and the throttle 251.

This embodiment reduces the number of parts and eliminates air leaking between the throttle and the surge tank.

( Fifth Embodiment )

Figure 18:
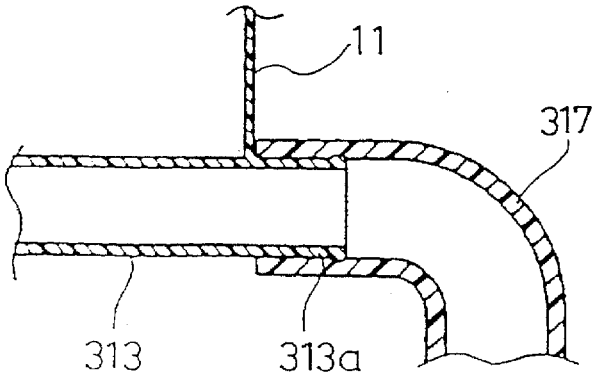
FIG. 18 is a cross-sectional side view illustrating a fuel passage of an air intake device according to a fifth embodiment of the present invention.

An air intake device according to a fifth embodiment is described with reference to FIG. 18 next.

The connection of a delivery pipe 313 and a fuel hose 317 is only different from that of the third embodiment. An end 313*a* of the delivery pipe 313 extends outward from the dusty-side case 11 and inserted into the -fuel supply hose 317. As a result, the connection can be carried out with ease.

The inner surface of the air cleaner cap 21 is a part of the duct described in the previous embodiment. However, the above duct 20 can be replaced with a cylindrical duct composed of the separate members. The duct 20, also, can be disposed on the air cleaner cap 21.

The air intake devices according to the present invention are described only with in-line type engines. However, they are available to other types of engines such as a V-engine.

The head cover 92, the dusty-side case 11, the throttle bore 51 and the surge tank 80 can be made of aluminum die-casting or metal plate instead of molding of resinous material. They can be combined into a unit by bolts or welding before mounted on the engine.

The duct 20 and the throttle 50 can be disposed in a vertical line so that the air cleaner cap 21 with the duct 20 is placed on the dusty-side case 11 from above, and the duct end 20*b* and the throttle bore end 51*a* meet each other in the vertical direction instead of the horizontal direction in the previous embodiments.

Although the present invention has been fully described in connection with the preferred embodiment thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. An air intake device for an internal combustion engine having a fuel supplying device comprising:

a case having an inlet, an outlet, a space connected between said inlet and said outlet, and a mount member, disposed below said outlet and adjacent to said engine, for mounting said fuel supplying device to supply fuel to said engine; and a filter element disposed detachably in said case to partition said space into a dusty-side space which includes said mount member and is connected to said inlet and a clean-side space which is connected to said outlet.

2. An air intake device as claimed in claim 1, wherein said case further comprises a second mount member disposed in said dusty side space for mounting an engine control circuit unit.

3. An air intake device as claimed in claim 1, wherein said filter element is disposed above with mount member.

4. An air intake device as claimed in claim 1, wherein said case comprises a lower case disposed under said filter element and upper case disposed over said filter element, and said fuel supplying means is disposed in said lower case.

5. An air intake device as claimed in claim 4, wherein said lower case has an opening for providing access to said mount member when said filter element is detached therefrom.

6. An air intake device as claimed in claim 4 further comprising an air duct, fixed to said case, for providing said outlet and an elongated outlet duct in said case.

7. An air intake device as claimed in claim 6, wherein said air duct comprises an open passage member and a cover member integrally formed on said case for covering said open passage member.

8. An air intake device as claimed in claim 4, wherein said engine has a surge tank formed of a resinous material integrally with said case.

9. An air intake device as claimed in claim 1, wherein said case further comprises air-intake pipes and has such length as to cover an entire row of said air intake pipes.

10. An air intake device as claimed in claim 9, wherein each of said air-intake pipes comprise a wall portion integrally molded with said case.

11. An air intake device as claimed in claim 1, wherein said mount member mounts said fuel injectors directly.

* * * * *